US007789737B2

(12) United States Patent
Liersch

(10) Patent No.: US 7,789,737 B2
(45) Date of Patent: Sep. 7, 2010

(54) RAPID LOCKING DEVICE

(75) Inventor: Ralph Liersch, Metzingen (DE)

(73) Assignee: Metabowerke GmbH, Nuertingen (DE)

( * ) Notice: Subject to any disclaimer, the term of this patent is extended or adjusted under 35 U.S.C. 154(b) by 417 days.

(21) Appl. No.: 11/631,369

(22) PCT Filed: Jul. 8, 2004

(86) PCT No.: PCT/EP2004/007504

§ 371 (c)(1),
(2), (4) Date: Dec. 29, 2006

(87) PCT Pub. No.: WO2006/005354

PCT Pub. Date: Jan. 19, 2006

(65) Prior Publication Data

US 2008/0305727 A1 Dec. 11, 2008

(51) Int. Cl.
*B24B 23/00* (2006.01)

(52) U.S. Cl. ..... 451/344; 451/359

(58) Field of Classification Search ..... 451/344, 451/357, 359, 360, 353
See application file for complete search history.

(56) References Cited

U.S. PATENT DOCUMENTS 4,989,374 A * 2/1991 Rudolf et al. ..... 451/342
5,157,873 A * 10/1992 Rudolf et al. ..... 451/342
5,263,283 A * 11/1993 Rudolf et al. ..... 451/344
5,601,483 A * 2/1997 Rudolf et al. ..... 451/359
6,569,001 B2 * 5/2003 Rudolf et al. ..... 451/344
6,910,694 B2 * 6/2005 Hartmann et al. ..... 279/141
7,344,435 B2 * 3/2008 Pollak et al. ..... 451/342

FOREIGN PATENT DOCUMENTS

DE 43 36 620 5/1995
DE 101 24 971 11/2002
WO WO 2005102605 A1 * 11/2005

* cited by examiner

*Primary Examiner*—Eileen P. Morgan
(74) *Attorney, Agent, or Firm*—Paul Vincent

(57) ABSTRACT

A rapid locking device axially secures a disc-type tool (16), in particular a grinding disc on the flange (24) of a driven spindle (14), the spindle (14) having an axial bore containing at least one locking element in the form of a plate spring (28), which co-operates with a locking pad (22). The tool can be locked between contact surfaces of the flange (24) and the locking pad (22), the distance between said surfaces being modifiable. The shank (30) of the locking pad (22) can be accommodated in the bore of the spindle (14) and can be secured in a friction fit by the locking element (20).

5 Claims, 2 Drawing Sheets

RAPID LOCKING DEVICE

This application is the national stage of PCT/EP2004/007504 filed on Jul. 08, 2004.

BACKGROUND OF THE INVENTION

The invention concerns a rapid locking device for axially securing a disc-shaped tool, in particular, a grinding disc, on a flange of a driven spindle.

There are a plurality of conventional rapid locking devices for axially securing a disc-shaped tool, in particular, a grinding disc.

In conventional rapid locking devices for right angle grinders, the spindle is retained with a fork wrench or an installed spindle stop when the grinding disc is in place. An adjusting nut is then manually applied and tightened using a wrench. When the machine is switched on, the spindle rapidly starts with a jerk, and the grinding disc is automatically tightened due to the inertial mass. During subsequent working, the locking device is automatically tightened further.

In order to change the tool, the spindle is held and the adjusting nut is released using a wrench. This often requires a large amount of force.

There are also machines having a special spindle stop that can be actuated shortly before the spindle stops, and suddenly blocks the spindle. In consequence thereof, the grinding disc continues to rotate due to its inertial mass, thereby possibly releasing the adjusting nut. When the spindle stop is triggered at an excessive rotational speed, the rapidly turning grinding disc may completely unscrew the adjusting nut and the still rotating disc may be released from the spindle and cause an accident or damage. In order to counteract this, special nuts are provided which have a damping element, but which are more complex to produce than normal adjusting nuts and are more difficult to remove for changing the tool, due to increased friction.

It is however desirable to provide a braking device that stops the threaded spindle on short notice when the electric drive has been switched off. In order to reduce the risk of danger to the user by reducing the risk of contacting a grinding disc that is still turning after the motor has been switched off. Up to now, the user had to hold the angle grinder in his/her hands until the grinding disc had come to a complete standstill. When the angle grinder is put down prior to reaching a complete standstill of the grinding disc, the support surface might be damaged or a person might be injured. A plurality of developments have been made in order to prevent release of grinding discs of so-called right angle grinders having a run-out brake. DE 42 43 328 C1 discloses e.g. a design, wherein the locking element consists of a locking part which is torque-proof relative to the spindle, and a part that can be screwed onto the threaded pin, which can be turned relative to each other, wherein a device is provided between the two locking parts or between the spindle and the locking part that can be screwed onto the threaded pin, to at least partially reduce relative motion between the two locking parts. A device of this type may e.g. be an O-ring DE 43 05 317 A1 moreover discloses a design with which a friction element is held in the adjusting nut and abuts the spindle in a friction-tight manner, in order to brake relative motion between the spindle and the adjusting nut.

DE 102 05 848 discloses a design, with which a pressure ring is provided in the nut, which can be clamped with the tool.

All above-described designs disadvantageously have relatively complex construction and the nut that projects past the tool has a relatively large axial size.

It is therefore the underlying purpose of the invention to provide an alternative solution which permits locking and adjustment of a tool, while preventing inadvertent release of the tool from the threaded spindle, e.g. during braking of the spindle.

SUMMARY OF THE INVENTION

This object is achieved in accordance with the invention by a fast locking device of the above-mentioned type, wherein the spindle has an axial bore housing at least one locking element that acts, in particular, in an axial direction, and cooperates with a dome-headed stud, wherein the tool can be clamped between bearing surfaces of the flange and the dome-headed stud, whose mutual separation can be changed, and a bolt of the dome-headed stud can be received in the bore of the spindle, and be frictionally fixed by the locking element.

The inventive design avoids force-locking fixation using a nut or a clamping screw that engages in an inner thread of the spindle, in favor of a friction-tight design. In this fashion, inadvertent release is prevented, in particular, by the purely axial retention.

The head of the dome-headed stud may moreover only slightly project past the tool. In contrast to the nut, wherein retention and force-locking is effected in the area of the nut and thereby axially outside of the tool, fixation is effected in the area of the bolt of the dome-headed stud and therefore in the spindle which does not project past the tool.

The dome-headed stud is moreover held in the locking element in a friction-tight fashion, wherein the locking element may, in particular, be formed by cup springs. The cup springs may be provided in the form of a slotted cup spring package, which are disposed such that they are inclined in a radial direction, wherein the outer periphery of the cup spring package preferably faces the tool and the inner periphery of the cup spring package faces an electric hand tool device that houses the rapid locking device. When the dome-headed stud is inserted into the cup spring package, the dome-headed stud is initially clamped, since there is only little play between the dome-headed stud and the cup spring package. The inclination of the cup springs permits insertion of the dome-headed stud. Pulling out in the opposite direction (the clamping direction of the cup springs) is, however, prevented through additional seating of the springs on the bolt of the dome-headed stud due to the preferably small, predetermined play. Other locking elements, such as friction linings etc. are also feasible.

In a first design, pretension may be provided before insertion of the dome-headed stud to effect initial clamping. After insertion of the dome-headed stud, a first or further tensioning action may moreover be alternatively or additionally applied using a locking device that may correspond to the pretensioning device and engages the cup spring package via auxiliary means, thereby loading them in such a fashion that the inner diameter of the cup spring package is reduced.

The locking device may thereby be designed to comprise, in particular, an adjusting element, such as e.g. a lever, wherein the lever is provided with a tooth sector, the lever and tooth sector cooperating with a toothing of a further element which directly or indirectly tensions the locking element. The lever may thereby be disposed e.g. in a first position, in particular, applied to the fast locking device, in which the tooth sector is not engaged. The lever may then be brought into a second position, e.g. by pivoting it about a pivot point, in which the teeth of the lever engage in a toothing of the further element. The lever may then perform an adjusting motion during a further motion about its pivot axis, thereby tightening the locking element. The lever may be returned into the initial position either manually or automatically. The tension is released in the reverse fashion.

Other locking devices are also, in principle, feasible.

Further clamping of the cup spring package and readjustment of the cup spring package relative to the dome-headed stud may be effected alternatively or additionally when an electric hand tool with applied fast locking device is started, since a relative motion between the flange and the tool during start of the spindle causes a relative motion and thereby clamping or readjustment, whereby the cup springs are further loaded in the direction towards their "locking position".

In order to facilitate readjustment by the relative motion, a friction element or a spring element may be provided between the flange and the tool in order to obtain reliable contact between the flange and the tool during release or readjustment. This additional element, which may, in particular, be formed by a friction element or a cup spring, ensures transmission of force and moments between the flange and the disc.

It may be particularly advantageous to design the frictional forces between the flange and the tool to facilitate readjustment.

Due to the fact that there is no spindle projecting past the tool, the inventive device is advantageous in that the spindle does not project past the tool even when the disc thickness varies. In particular, for grinding discs with a small height, the conventional devices are disadvantageous in that the spindle considerably projects past the tool in an axial direction, which can damage the workpiece during working with the tool spindle.

The inventive design is also advantageous in that conventional grinding discs and other disc-shaped machining means may be used in contrast to some prior art devices which require special grinding discs when a braking device is provided.

The inventive system is also advantageous in that the tool can be rapidly changed without having to lock the spindle, since no rotation is required for changing, re-clamping and releasing the tool.

In particular, for releasing the tool, the dome-headed stud is advantageously decoupled from the tool with regard to transmission of torques. Towards this end, a tongue and groove arrangement may be provided in accordance with one embodiment, whereby the dome-headed stud is directly coupled to the spindle. In this fashion, the frictional forces in the peripheral direction need not be accepted by the locking element.

The readjusting effect is generally reversed during braking of the tool, i.e. the tool continues to rotate relative to the flange, thereby releasing the tension of the locking element, in particular, of the cup springs which increasingly reassume their inclined position. Moreover, the springs only transmit axial and no radial forces, such that the dome-headed stud can be simply lifted out of the opening as soon as the locking moment has been released. For this reason, no tools are generally required for exchange.

The invention also concerns an electric hand tool, in particular, a right angle grinder with a rapid locking device in accordance with the claims.

BRIEF DESCRIPTION OF THE DRAWING

The invention is described in more detail below with reference to a drawing.

DESCRIPTION OF THE PREFERRED EMBODIMENT

Figure 1:
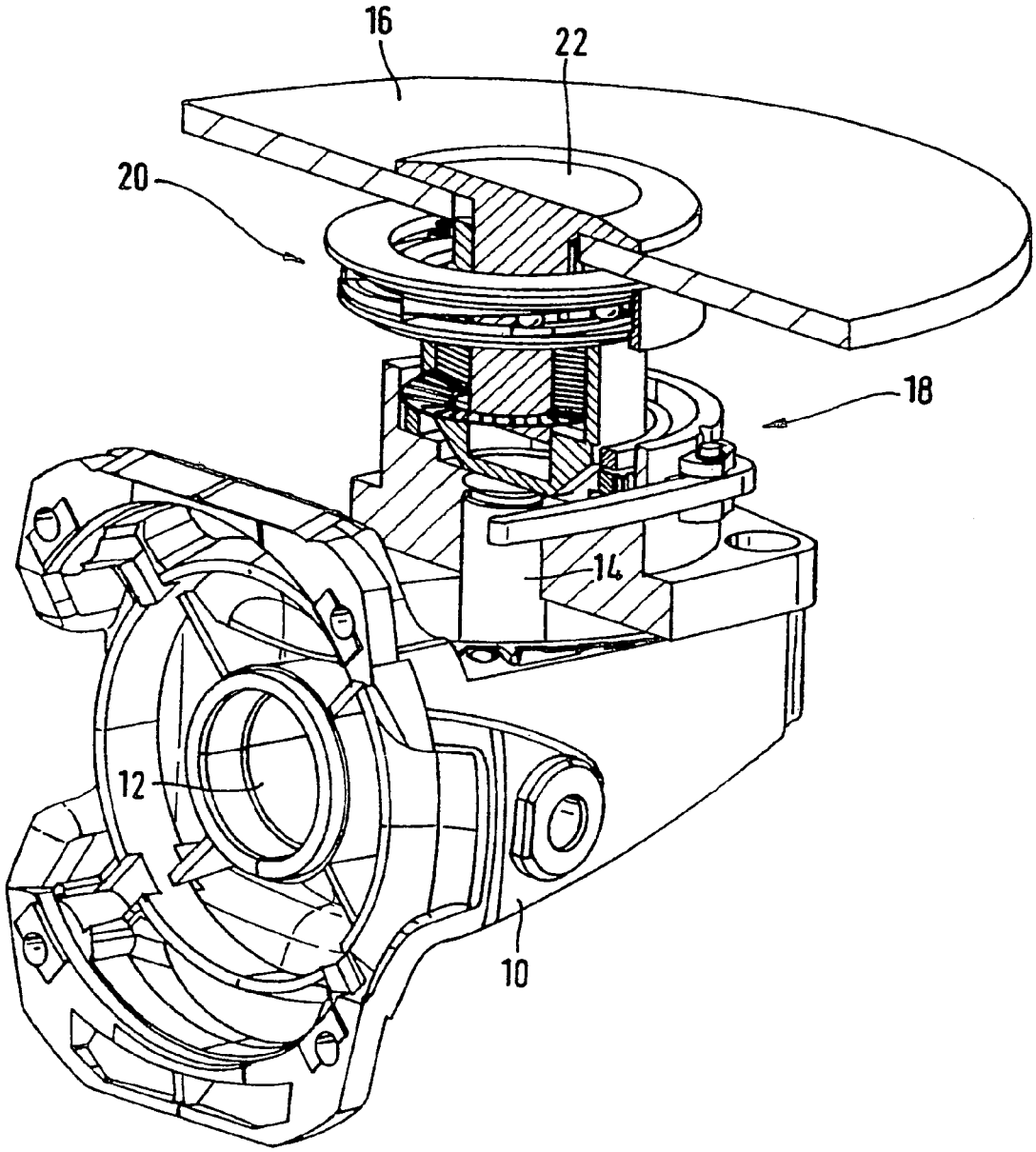
FIG. 1 shows part of a housing of an angle grinder comprising an inventive fast locking device.

FIG. 1 shows a housing 10 for receiving a drive shaft in an opening 12 of the housing 10, which is connected to a spindle 14 for driving a tool 16 which is formed by a grinding disc in the present case. A transmission (not shown) is thereby disposed in the housing 10. The grinding disc is thereby clamped using a fast locking device which is designated in total with reference numeral 18. The fast locking device 18 comprises a part 20 on the side of the electric machine, and a dome-headed stud 22 which cooperates with the part 20.

Figure 2:
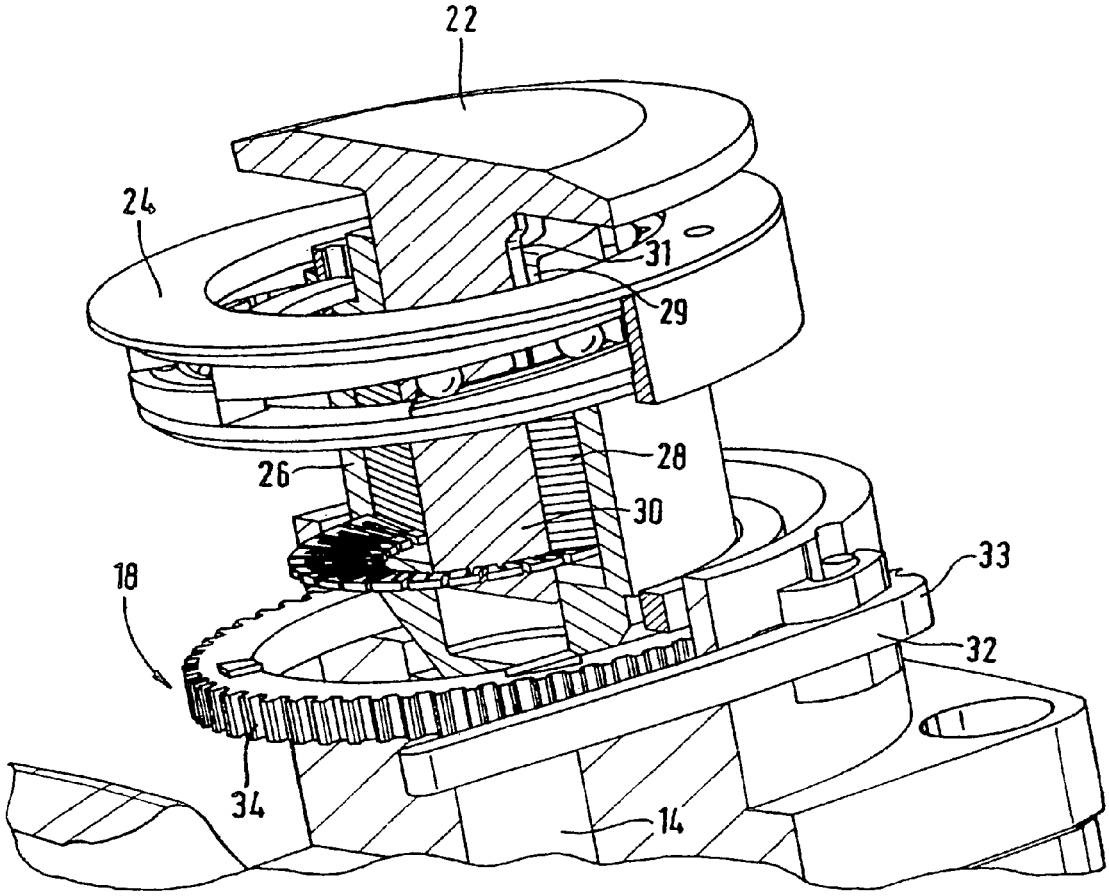
FIG. 2 shows a detailed view of FIG. 1.

FIG. 2 shows a section of FIG. 1, without tool and with the fast locking device 18. The fast locking device 18 comprises a flange 24 on which the grinding disc 16 abuts. For mounting the grinding disc 16 with an inventive device, the grinding disc 16 is disposed on the flange 24 and the dome-headed stud 22 is inserted into an opening of a cylinder 26 which cooperates with the spindle 14, thereby forming part of the spindle 14. The cylinder 26 has cup springs 28 in its inside, which are designed as slotted cup springs, and whose outer diameter is closer to the grinding disc 16 than their inner diameter. There is only a small gap between the bolt 30 of the dome-headed stud 22 and the inner diameter of the cup spring package 28.

In order to ensure pretensioning of the cup spring package for secure axial friction grip between the cup spring package 28 and the bolt 30, a pretensioning device 32 may be provided which causes the cup springs 28 to bulge via a toothed wheel 34 and a ramp arrangement, such that their inner diameter decreases. Adjustment is thereby performed through pivoting the lever 33 that is connected to a tooth sector that can be brought into engagement with the toothed wheel 34 through a first pivot motion, and effects clamping through a further pivoting motion. The lever 33 is thereby shown in its applied basic position in which it is out of engagement. When a corresponding electric hand tool is started, the grinding disc 16 initially remains stationary due to the inertial mass, and subsequently the flange 24 turns, causing a relative motion and loading of the cup spring package, thereby readjusting the dome-headed stud 22.

After termination of the grinding process, the spindle 14 is decelerated via a braking device (not shown), upon which the readjustment is released through further relative motion between the flange 24 and the grinding disc 16, since the grinding disc 16 has a certain after-run in consequence of its inertial mass. The clamping forces are still sufficient to prevent release of the dome-headed stud 22. However, the dome-headed stud 22 can be axially removed from the holder without further auxiliary means, in particular, since no force is transmitted from the grinding disc 16 to the dome-headed stud 22 due to its design. The dome-headed stud 22 has webs or springs 31 in the area of its bolt 30, which engage in grooves 29 of the spindle 14 to provide direct torque transmission and decoupling from the tool.

In this fashion, the three main criteria for rapid changing systems, i.e. retention, continuous adjustment and readjustment are ensured.

In particular, due to the fact that there is no spindle 14 in the axial direction in the area of the tool 16, grinding discs of any thickness may be inserted easily, without any part of the spindle 14 axially projecting past the grinding disc 16. In this fashion, the disc can be advantageously used, in particular, for so-called scrubbing works. Moreover, this is advantageous in any case in that damage to the workpiece caused by projecting spindles is prevented.

In addition to the advantageous rapid tool change, the inventive rapid changing system 18 is therefore also advantageous due to the secure retention of the grinding disc even when the spindle is decelerated, wherein at the same time conventional grinding discs from any other producer may be used.

I claim:

1. A rapid locking device for axially clamping a disc-shaped tool or a grinding disc, the device comprising:

a driven spindle having an inside wall defining an axial bore, said spindle also having a flange;

at least one locking element disposed in said axial bore, said locking element having cup springs;

a stud having a domed head and a bolt, wherein the tool is disposed between said head of said stud and said flange, said bolt being inserted into said bore of said spindle;

a pretensioning device;

a toothed cooperating with said pretensioning device; and a ramp arrangement cooperating with said toothed wheel and said locking element, wherein said pretensioning device causes said cup springs to bulge via said toothed wheel and said ramp arrangement, thereby deceasing an inner diameter of said cup springs to effect secure axial frictional grip between the cup springs and the bolt and frictionally clamp said bolt within said inside wall of said spindle to secure the tool for rotation along with said driven spindle.

2. The rapid locking device of claim 1, wherein said stud is decoupled from the tool with respect to transmission of torques.

3. The rapid locking device of claim 1, wherein the tool can be readjusted and readjustment can be released through relative motion between the tool and said flange.

4. The rapid locking device of claim 1, wherein said locking element acts in an axial direction.

5. An electric hand tool or a right angle grinder comprising:

a housing; and a rapid locking device cooperating with said housing for axially clamping a disc-shaped tool or a grinding disc, the rapid locking device having a driven spindle having an inside wall defining an axial bore and having a flange, at least one locking element disposed in said axial bore, said locking element having cup springs, stud having a domed head and a bolt, wherein the tool is disposed between said head of said stud and said flange, said bolt being inserted into said bore of said spindle, a pretensioning device, a toothed wheel cooperating with said pretensioning device and a ramp arrangement cooperating with said toothed wheel and said locking element, wherein said pretensioning device causes said cup springs to bulge via said toothed wheel and said ramp arrangement, thereby decreasing an inner diameter of said cup springs to effect secure axial frictional grip between the cup springs and the bolt and frictionally clamp said bolt within inside wall of said spindle to secure the tool for rotation along with said driven spindle.

* * * * *